US009505993B2

(12) United States Patent
Gornay et al.

(10) Patent No.: US 9,505,993 B2
(45) Date of Patent: Nov. 29, 2016

(54) PROCESS FOR THE HYDRODESULPHURIZATION OF HYDROCARBON CUTS

(71) Applicant: IFP ENERGIES NOUVELLES, Rueil-Malmaison (FR)

(72) Inventors: Julien Gornay, Les Cotes d Arey (FR); Philibert Leflaive, Mions (FR); Olivier Touzalin, Lyons (FR); Annick Pucci, Croissy sur Seine (FR); Delphine Largeteau, Houston, TX (US)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 160 days.

(21) Appl. No.: 14/572,946

(22) Filed: Dec. 17, 2014

(65) Prior Publication Data

US 2015/0166907 A1 Jun. 18, 2015

(30) Foreign Application Priority Data

Dec. 18, 2013 (FR) ..... 13 62892

(51) Int. Cl.
*C10G 65/02* (2006.01)
*C10G 65/04* (2006.01)
(Continued)

(52) U.S. Cl.
CPC ..... *C10G 67/02* (2013.01); *C10G 45/04* (2013.01); *C10G 45/08* (2013.01); *C10G 65/04* (2013.01); *C10G 2300/104* (2013.01); *C10G 2300/1044* (2013.01); *C10G 2300/1051* (2013.01);
(Continued)

(58) Field of Classification Search
CPC ..... C10G 45/04; C10G 45/08; C10G 67/02; C10G 65/00; C10G 65/02; C10G 65/04; C10G 2300/104; C10G 2300/1044; C10G 2300/1051; C10G 2300/1055; C10G 2300/1059; C10G 2300/202
See application file for complete search history.

(56) References Cited

U.S. PATENT DOCUMENTS 3,265,610 A 8/1966 Lavergne et al.
3,968,026 A 7/1976 Frayer et al.
(Continued)

FOREIGN PATENT DOCUMENTS

EP 0902078 A2 3/1999
WO 02/31088 A1 4/2002

OTHER PUBLICATIONS

Search Report dated Oct. 20, 2014 issued in corresponding FR 1362892 application (pp. 1-2).

*Primary Examiner* — Brian McCaig
(74) *Attorney, Agent, or Firm* — Millen, White, Zelano and Branigan, P.C.

(57) ABSTRACT

A process for the concomitant production of at least two hydrocarbon cuts with low sulphur contents from a mixture of hydrocarbons having a total sulphur content in the range 30 to 10000 ppm by weight, by a) hydrodesulphurization in the presence of hydrogen and a hydrodesulphurization catalyst;
b) separating hydrogen sulphide from the partially desulphurized effluent obtained from a);
c) hydrodesulphurization of the partially desulphurized mixture obtained from b) in the presence of hydrogen and a hydrodesulphurization catalyst, the temperature of the second hydrodesulphurization being higher than that of the first hydrodesulphurization;
d) fractionating the desulphurized mixture obtained in c) into at least two desulphurized hydrocarbon cuts.

15 Claims, 1 Drawing Sheet

(51) Int. Cl.

| | |
|---|---|
| ***C10G 67/02*** | (2006.01) |
| ***C10G 45/04*** | (2006.01) |
| ***C10G 45/08*** | (2006.01) |
| *C10G 65/00* | (2006.01) |

(52) U.S. Cl.

CPC ..... *C10G2300/1055* (2013.01); *C10G 2300/1059* (2013.01); *C10G 2300/202* (2013.01); *C10G 2400/02* (2013.01); *C10G 2400/04* (2013.01); *C10G 2400/06* (2013.01)

(56) References Cited

U.S. PATENT DOCUMENTS

| | | | | |
|---|---|---|---|---|
| 4,016,070 | A | 4/1977 | Christman et al. | |
| 5,290,427 | A | 3/1994 | Fletcher et al. | |
| 2002/0008049 | A1* | 1/2002 | Inomata ..... | C10G 65/04 208/57 |
| 2011/0210045 | A1 | 9/2011 | Kou et al. | |
| 2013/0313161 | A1 | 11/2013 | Dindi | |

* cited by examiner

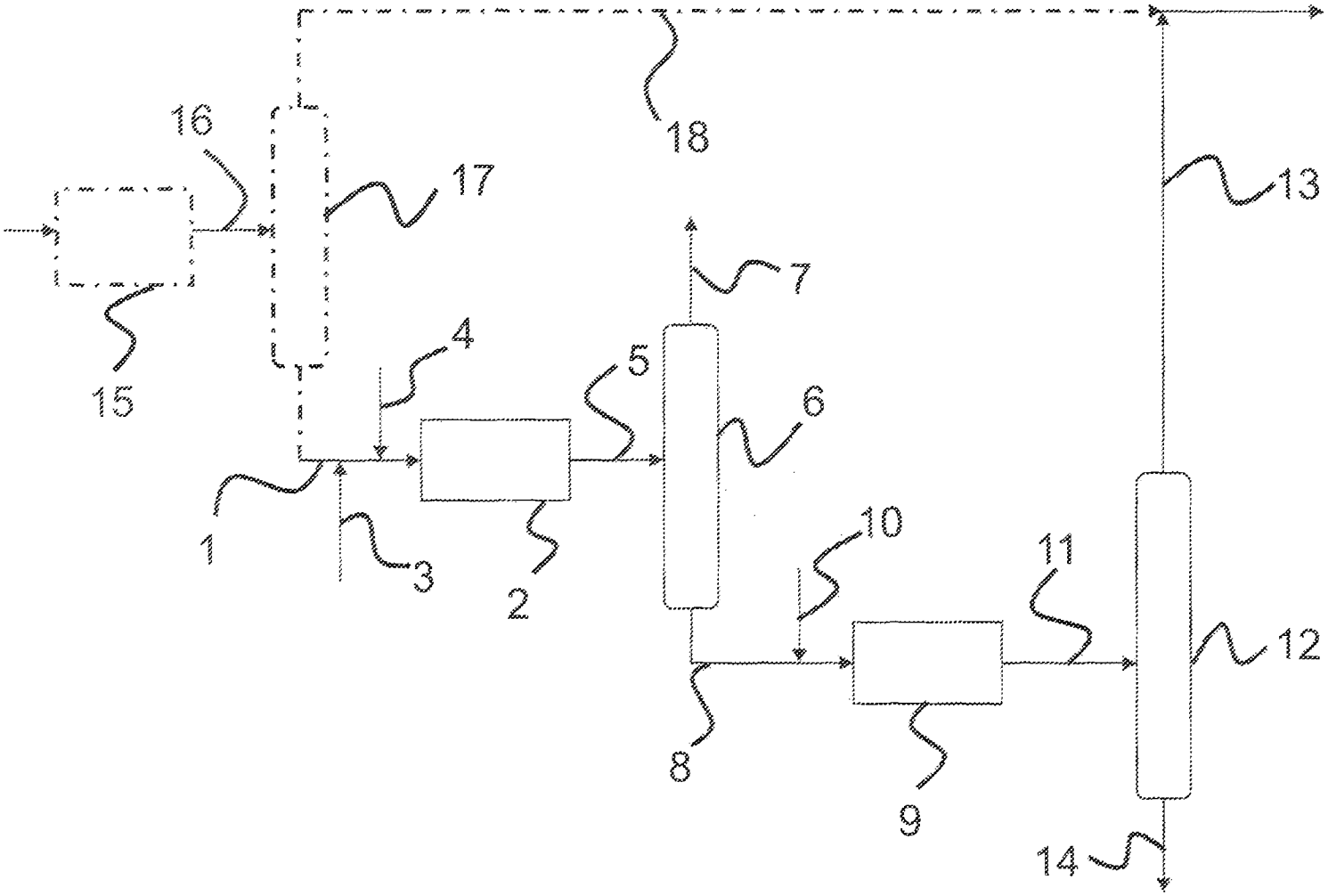
13
12
14
11
9
10
7
6
18
8
5
2
17
4
3
16
1
15

PROCESS FOR THE HYDRODESULPHURIZATION OF HYDROCARBON CUTS

The present invention relates to a process for the concomitant production of at least two hydrocarbon cuts with low sulphur contents. In particular, the process can be used to jointly desulphurize (as a mixture) a gasoline cut containing olefins and a cut which is heavier than the gasoline cut so as to produce as a result a desulphurized gasoline cut with a limited octane number loss and a heavy cut which is also desulphurized.

The present invention is of particular importance in the production of at least two desulphurized cuts which are capable of being sent respectively to the gasoline pool and to the diesel, kerosene and/or fuel oil pool.

PRIOR ART

Sulphur in fuels is an unwanted impurity as it is converted into oxides of sulphur when these products are burned. Oxides of sulphur are undesirable atmospheric pollutants which can also deactivate the majority of the catalysts which have been developed for catalytic converters used in automobiles to catalyse the conversion of harmful exhaust gases. As a consequence, it is desirable to reduce the sulphur content of products which form part of the compositions of the gasoline and diesel fuel to levels which are as low as possible.

Catalytically cracked gasoline is the essential product from FCC (Fluid Catalytic Cracking), obtained in a yield of the order of 50% and representing approximately 25% to 30% of the gasoline pool in Western European refineries. The principal negative characteristic of these FCC gasolines having regard to commercial fuels is their high sulphur content, and thus they constitute the principal vector for the presence of sulphur in the fuels.

In order to comply with sulphur specification constraints, the hydrocarbons produced from catalytic cracking processes are conventionally treated by hydrotreatment. The hydrotreatment process comprises bringing the hydrocarbon feed into contact with hydrogen in the presence of a catalyst in order to convert the sulphur contained in the impurities into hydrogen sulphide, which can then be separated and converted into elemental sulphur. The hydrotreatment processes can bring about partial destruction of the olefins of the feed by converting them into saturated hydrocarbons by hydrogenation. This destruction of olefins by hydrogenation is not desirable in the case of cracked gasolines, as it results in an expensive consumption of hydrogen and a significant reduction in the octane number of the hydrodesulphurized gasolines.

The residual sulphur-containing compounds generally present in the desulphurized gasoline may be separated into two distinct families: sulphur-containing compounds which have not been hydrodesulphurized present in the feed and sulphur-containing compounds formed in the hydrodesulphurization reactor by secondary reactions known as recombination. In this last family of sulphur-containing compounds, the majority compounds are mercaptans obtained by the addition of the $H_2S$ formed in the reactor to the mono-olefins present in the feed. The reduction in the recombination mercaptans content may be obtained by catalytic hydrodesulphurization, but at the cost of saturation of a large proportion of the mono-olefins which then brings about a large reduction in the octane number of the gasoline as well as over-consumption of hydrogen.

Currently, in many countries and in particular in Europe, the fuels market is essentially becoming orientated towards that of diesel and kerosene, which has the effect that many European refiners are confronted with problems regarding the overcapacity of their units dedicated to the production of desulphurized gasoline cuts and their under-capacity as regards hydrodesulphurization units which process intermediate distillate cuts forming part of the composition of the diesel and/or kerosene fuel.

Thus, there is currently a need for processes which can allow the refiner to respond better to market demands by using existing overcapacities as regards units for the hydrodesulphurization of gasoline cuts.

In the prior art, the document EP 0 902 078 is known which discloses a process for processing crude oil, which comprises the following steps:

- a step for atmospheric distillation of oil in order to separate a distillate comprising diesel and fractions with a boiling temperature lower than that of gas oil;
- a first step for hydrodesulphurization of the distillate;
- a second step for hydrodesulphurization of the partially desulphurized distillate which is carried out at a temperature below that of the first hydrodesulphurization step; and
- a step for separating the desulphurized distillate into diesel, kerosene, heavy naphtha and light naphtha fractions.

The process of document EP 0 902 078 thus treats a distillate obtained from an atmospheric distillation step. That type of distillate contains practically no olefinic hydrocarbon compounds, in contrast to the feed treated in the present invention wherein one of the cuts in it contains a high olefins content, typically more than 20% by weight with respect to the total weight of said cut. The recombination sulphur-containing compounds primarily encountered in the process of document EP 0 902 078 are thus not mercaptans obtained by the addition of the $H_2S$ formed in the reactor to the mono-olefins present in the feed, but probably the result of the addition of the $H_2S$ formed to olefins obtained from cracking reactions induced by the high temperature necessary for the very intense desulphurization of the feed. In fact, the heavy naphtha obtained from the atmospheric distillation is generally intended to be converted in a catalytic reforming unit and thus as a consequence has to be intensively desulphurized (the total sulphur content is typically less than 1 ppm by weight). In contrast, the admissible sulphur specification in a gasoline pool is less severe (approximately 10 ppm by weight). Thus, in the case of hydrodesulphurization of a distillate comprising diesel and fractions with a boiling temperature below that of the diesel obtained from atmospheric distillation, the skilled person will seek to maximize the hydrodesulphurization reaction while avoiding reactions (in particular cracking reactions) which are susceptible of forming olefins.

The solution recommended by patent EP 0 902 078 consists of carrying out an intense hydrodesulphurization at high temperature in a first reactor followed by a less intense hydrodesulphurization in a second reactor which can be used to eliminate any possible recombination mercaptans and/or olefins which might have been produced in the first reactor. This modus operandum is unsuitable for a feed containing a gasoline obtained from a conversion unit with a high olefins content, as it risks causing substantial hydrogenation of said olefins during the first step, thereby causing an unwanted loss of octane number.

The document US 2013/0087484 describes a process for the production of p-xylene starting from a mixture of naphtha and light cycle oil (LCO) obtained from a catalytic cracking unit. The process comprises a step for hydrodesulphurization of said mixture followed by fractionation of the desulphurized effluent into three cuts, namely a light $C_2$-$C_4$ cut, a naphtha cut and a heavy cut. The intermediate naphtha cut is treated in a catalytic reforming unit to produce aromatic compounds and the heavy cut is hydrocracked to provide an effluent which is rich in aromatics which is recycled to the fractionation column.

The document FR 2837831 describes a process for hydrodesulphurization of a gasoline cut obtained from catalytic cracking or from cokefaction of a heavy hydrocarbon feed involving:

- a first step for hydrodesulphurization of said gasoline cut;
- a step for separation of the major portion of the $H_2S$ from the effluent obtained from the first hydrodesulphurization step;
- a second step for hydrodesulphurization of said gasoline cut freed of $H_2S$.

According to that document, the second hydrodesulphurization step is carried out at a temperature at least 10° C. lower, preferably at least 20° C. lower than that of the first hydrodesulphurization step.

The prior art also includes the document FR 2811328, which discloses a process for hydrodesulphurization of a gasoline cut which may be a mixture of gasolines deriving from different conversion processes such as processes for steam cracking, cokefaction or visbreaking, or even gasolines obtained directly from the atmospheric distillation of oil.

One aim of the invention is to provide a hydrodesulphurization process which can overcome the overcapacity problems of gasoline hydrodesulphurization units.

SUMMARY OF THE INVENTION

Thus, the invention concerns a process for the concomitant production of at least two hydrocarbon cuts with low sulphur contents from a mixture of hydrocarbons having an initial boiling temperature in the range 35° C. to 100° C. and a final boiling temperature in the range 260° C. to 340° C. and having a total sulphur content in the range 30 to 10000 ppm by weight, said hydrocarbon mixture comprising:

- at least one first fraction comprising hydrocarbons having a boiling temperature range in the range from the initial boiling temperature of the mixture to 160° C. and with an olefins content in the range 20% to 80% by weight of said first fraction; and
- at least one second fraction comprising hydrocarbons having a boiling temperature range in the range 160° C. to the final boiling temperature of the mixture, said second fraction comprising at least 10% by weight of hydrocarbons with a boiling temperature range in the range 220° C. to the final boiling temperature of the mixture;

the process comprising the following steps:

a) in a first reactor, treating the mixture in a first hydrodesulphurization step in the presence of hydrogen and a catalyst comprising at least one metal from group VIII, at least one metal from group VIB and a support, the first hydrodesulphurization step being carried out at a temperature in the range 200° C. to 400° C., at a pressure in the range 1 to 10 MPa, with a liquid hourly space velocity in the range 0.1 to 10 $h^{-1}$ and with a (volume of hydrogen/volume of hydrocarbon mixture) ratio in the range 50 to 500 Nliter/liter;

b) separating at least a portion of the hydrogen sulphide from the partially desulphurized effluent obtained from step a);

c) in a second reactor, treating the partially desulphurized mixture obtained from step b) in a second hydrodesulphurization step in the presence of hydrogen and a catalyst comprising at least one element from group VIII, at least one element from group VIB and a support, the second hydrodesulphurization step being carried out at a temperature in the range 205° C. to 500° C., at a pressure in the range 1 to 3 MPa, with a liquid hourly space velocity in the range 1 to 10 $h^{-1}$ and with a (volume of hydrogen/volume of mixture) ratio in the range 50 to 50 Nliter/liter, the temperature of the second hydrodesulphurization step c) being higher than that of the first hydrodesulphurization step a); and d) fractionating the desulphurized mixture obtained from step c) into at least two desulphurized hydrocarbon cuts, light and heavy, the light hydrocarbon cut having an initial boiling temperature in the range 35° C. to 100° C. and a final boiling temperature in the range 160° C. to 220° C. and wherein the total sulphur content is less than 50 ppm by weight and the heavy hydrocarbon cut has an initial boiling temperature in the range 160° C. to 220° C. and a final boiling temperature in the range 260° C. to 340° C.

In the context of the invention, the boiling temperatures can fluctuate by plus or minus 5° C. with respect to the values mentioned.

The inventors have surprisingly observed that it is possible to hydrodesulphurize a mixture containing a gasoline cut and a distillate cut charged with sulphur and having a low olefins content conjointly in order to produce a gasoline cut with a low sulphur content, in particular of mercaptans, without significant loss of octane number and a distillate cut which is depleted in sulphur which can then be upgraded to the diesel pool and/to kerosene pool or as a fuel for maritime use.

In particular, the treatment in the first step for hydrodesulphurization of the hydrocarbon mixture surprisingly results in limiting the formation of recombination mercaptans, produced by the addition reaction of $H_2S$ with olefins, and of thus obtaining a gasoline cut with a very low mercaptans content at the end of the process. The second hydrodesulphurization step is carried out under conditions which subsequently favour hydroconversion of the most refractory sulphur-containing compounds which essentially originate from the distillate cut.

The process of the invention satisfactorily overcomes the problem of overcapacities of units for the hydrodesulphurization of gasolines in that these very units can now act to cojointly desulphurize gasoline cuts and middle or heavy distillate cuts which are bases for the formulation of diesel and/or kerosene fuels or fuels for use as maritime fuels with a low sulphur content.

DETAILED DESCRIPTION OF THE INVENTION

Thus, the invention concerns a process employing at least two successive steps for hydrodesulphurization of a mixture of hydrocarbons comprising a first and a second hydrocarbon fraction with an intermediate step for the elimination of hydrogen sulphide ($H_2S$) formed in the first hydrodesulphurization step and with a reaction temperature in the second hydrodesulphurization step which is higher than that of the first hydrodesulphurization step.

In a preferred implementation, the catalyst for step a) is a hydrodesulphurization catalyst which comprises a metal from group VIII selected from nickel and cobalt and a metal from group VIB selected from molybdenum and tungsten.

Preferably, the catalyst for step c) is also a hydrodesulphurization catalyst which comprises a metal from group VIII selected from nickel and cobalt and a metal from group VIB selected from molybdenum and tungsten.

Preferably, the first hydrocarbon fraction containing olefins is a gasoline cut and highly preferably, the gasoline cut is obtained from a catalytic cracking unit.

The second hydrocarbon fraction of the mixture treated by the process of the invention is preferably selected from a light cycle oil cut obtained from a catalytic cracking unit (LCO), a light or heavy diesel cut, for example obtained from straight-run distillation of oil, a vacuum distillate cut, a cut of distillates obtained from a thermal cracking unit such as, for example a visbreaking unit or a coking unit (for example a delayed coking unit).

Preferably, the feed for the process of the invention is a mixture containing a catalytically cracked gasoline cut and a light cycle oil, LCO. Advantageously, said mixture is the product of a distillation of an effluent obtained from a catalytic cracking unit.

Preferably, only the light LCO fraction, i.e. compounds with a boiling temperature of less than 300° C., and highly preferably less than 265° C., is used as a mixture with the catalytically cracked gasoline.

Preferably, the first fraction or hydrocarbon cut represents in the range 30% to 70% by weight of the mixture.

In an alternative embodiment, the first fraction of the mixture is a heavy fraction of a catalytically cracked gasoline and the second fraction is a light oil cut, LCO. The heavy fraction of the catalytically cracked gasoline is obtained by distillation of a catalytically cracked gasoline into two fractions, a light C5− fraction comprising hydrocarbons containing in the range 2 to 5 carbon atoms and a heavy C6+ fraction comprising hydrocarbons containing 6 or more carbon atoms.

In a highly preferred embodiment, before the step for separation of the catalytically cracked gasoline into two fractions, said gasoline cut is treated in a step for selective hydrogenation of the diolefins.

Other characteristics and advantages of the invention will become apparent from the following description provided solely by way of non-limiting illustration. In the accompanying drawing:

BRIEF DESCRIPTION OF THE FIGURE

FIG. 1 shows a layout showing the principle of the process of the invention.

Referring to FIG. 1, the first hydrocarbon cut treated by the process of the invention is sent to a first hydrodesulphurization reactor 2 via the line 1. This first hydrocarbon cut is also combined (mixed) with a second hydrocarbon cut supplied via the line 3. The mixture, which can be considered to be constituted by two fractions, is then treated in the first hydrodesulphurization reactor 2.

The first hydrocarbon cut, which constitutes all or a portion of the first fraction of the mixture, is, for example, an olefinic gasoline cut obtained from a catalytic cracking, steam cracking, coking or visbreaking unit. Preferably, the gasoline cut is a catalytically cracked gasoline. Typically, the gasoline cut has an initial boiling temperature in the range 35° C. to 100° C. and a final boiling temperature in the range 130° C. to 200° C., preferably in the range 150° C. to 170° C. and more preferably in the range 155° C. to 165° C. In general, the olefins content of the first cut (or first fraction composing the mixture) is in the range 20% to 80% by weight of said cut.

The second hydrocarbon cut has an initial boiling temperature of approximately 160° C. and a final boiling temperature in the range 260° C. to 340° C. and comprises a fraction of at least 10% by weight of hydrocarbons with a boiling temperature in the range from 220° C. to its final boiling temperature. This second cut thus constitutes all or a portion of the second fraction of the mixture.

This second hydrocarbon cut corresponds, for example, to a distillate cut, preferably selected from a light cycle oil (LCO) obtained from a catalytic cracking unit, a light or heavy diesel cut, for example obtained from straight-run oil, a vacuum distillate cut, or a cut of distillates obtained from a thermal cracking unit such as, for example, a visbreaking unit or a coking unit, for example a delayed coking unit.

This second cut has a lower olefins content than that of the first cut and a total sulphur content which is higher than that of the first cut. Preferably, the second hydrocarbon cut is a light cycle oil obtained from a catalytic cracking unit (LCO).

Thus, the treated mixture of hydrocarbons has an initial boiling temperature in the range 35° C. to 100° C. and a final boiling temperature in the range 260° C. to 340° C. and a total sulphur content in the range 30 to 10000 ppm by weight. The treated mixture comprises:

- at least one first fraction comprising hydrocarbons with a boiling temperature range in the range from the initial boiling temperature of the mixture to 160° C. and with an olefins content in the range 20% to 80% by weight of said first fraction; and
- at least one second fraction comprising hydrocarbons with a boiling temperature range in the range 160° C. to the final boiling temperature of the mixture.

In accordance with the invention, said second fraction comprises at least 10% by weight of hydrocarbons with a boiling temperature range in the range from 220° C. to the final boiling temperature of the mixture.

The first hydrodesulphurization step can be used to convert a portion of the sulphur present in the mixture into hydrogen sulphide ($H_2S$). It consists of passing the mixture of hydrocarbons to be treated in the presence of hydrogen (supplied via the line 4) over a hydrodesulphurization catalyst at a temperature in the range 200° C. to 400° C., preferably in the range 250° C. to 340° C. and at a pressure in the range 1 to 10 MPa, preferably in the range 1.5 to 4 MPa. The liquid hourly space velocity is generally in the range 1 to 10 $h^{-1}$, preferably in the range 2 to 5 $h^{-1}$, and the $H_2$/HC ratio is in the range 50 Nliters/liter (L/L) to 500 Nliters/liter, preferably in the range 100 Nliters/liter to 450 Nliters/liter, more preferably in the range 150 Nliters/liter to 400 Nliters/liter. The $H_2$/HC ratio is the ratio between the volumetric flow rate of hydrogen in 1 atmosphere at 0° C. and the volumetric hydrocarbon flow rate.

The effluent obtained from this hydrodesulphurization step which is withdrawn via the line 5 comprises the partially desulphurized mixture of hydrocarbons, the residual hydrogen and the $H_2S$ produced by decomposition of the sulphur-containing compounds. This hydrodesulphurization step is, for example, carried out in a fixed bed or moving bed reactor.

The catalyst used during the first hydrodesulphurization step of the hydrodesulphurization process of the invention comprises an active metallic phase deposited on a support, said active phase comprising at least one metal from group VIII of the periodic classification of the elements (groups 8, 9 and 10 in the new notation for the periodic classification of the elements: Handbook of Chemistry and Physics, 76th edition, 1995-1996) and at least one metal from group VIB of the periodic classification of the elements (group 6 of the new notation for the periodic classification of the elements: Handbook of Chemistry and Physics, 76th edition, 1995-1996). Preferably, the active phase of said catalyst further comprises phosphorus. The catalyst for the first hydrodesulphurization step may also contain one or more organic compounds.

In general, the quantity of metal(s) from group VIB in said catalyst for the first hydrodesulphurization step is in the range 4% to 40% by weight of the oxide(s) of the metal(s) from group VIB, preferably in the range 8% to 35% by weight of the oxide(s) of the metal(s) from group VIB, highly preferably in the range 10% to 30% by weight of the oxide(s) of the metal(s) from group VIB with respect to the total catalyst weight. Preferably, the metal from group VIB is molybdenum or tungsten or a mixture of these two elements, and more preferably, the metal from group VIB is uniquely constituted by molybdenum or tungsten. Highly preferably, the metal from group VIB is molybdenum.

In general, the quantity of metal(s) from group VIII in said catalyst for the first hydrodesulphurization step is in the range 1.5% to 9% by weight of oxide(s) of metal(s) from group VIII, preferably in the range 2% to 8% by weight of oxide(s) of metal(s) from group VIII with respect to the total catalyst weight. Preferably, the metal from group VIII is a non-noble metal from group VIII of the periodic classification of the elements. Highly preferably, said metal from group VIII is cobalt or nickel or a mixture of these two elements, and more preferably, the metal from group VIII is constituted uniquely by cobalt or nickel. Highly preferably, the metal from group VIII is cobalt.

The molar ratio of metal(s) from group VIII to metal(s) from group VIB in the catalyst in the oxide form is in the range 0.1 to 0.8, highly preferably in the range 0.2 to 0.6, and still more preferably in the range 0.3 to 0.5.

When the catalyst contains phosphorus, the quantity of phosphorus in the catalyst for the first hydrodesulphurization step is preferably in the range 0.1% to 20% by weight of $P_2O_5$, more preferably in the range 0.2% to 15% by weight of $P_2O_5$, highly preferably in the range 0.3% to 10% by weight of $P_2O_5$ with respect to the total catalyst weight.

The molar ratio of phosphorus to metal(s) from group VIB in the catalyst for the first hydrodesulphurization step is 0.05 or more, preferably 0.1 or more, more preferably in the range 0.15 to 0.6 and still more preferably in the range 0.15 to 0.5.

The support for the catalyst for the first hydrodesulphurization step on which the active phase is deposited is advantageously formed by at least one porous solid in the oxide form selected from the group constituted by aluminas, silicas, silica-aluminas or oxides of titanium or magnesium, used alone or as a mixture with the alumina or the silica-alumina. It is preferably selected from the group constituted by silicas, transition aluminas and silica-aluminas. More preferably, said support is uniquely constituted by a transition alumina or a mixture of transition aluminas. The specific surface area of the catalyst is generally in the range 100 to 400 $m^2/g$, preferably in the range 150 to 300 $m^2/g$. The catalyst for the first hydrodesulphurization step is advantageously in the form of beads, extrudates, pellets or irregular and non-spherical agglomerates the specific shape of which may result from a crushing step. Highly advantageously, said support is in the form of beads or extrudates.

The catalyst for the first hydrodesulphurization step is preferably used at least partially in its sulphurized form. Sulphurization consists of passing a feed containing at least one sulphur-containing compound which, once decomposed, fixes sulphur on the catalyst. This feed may be gaseous or liquid, for example hydrogen containing $H_2S$, or a liquid containing at least one sulphur-containing compound. The sulphurization step may be carried out in situ, i.e. within the process of the invention, or ex situ, i.e. in a unit dedicated to sulphurization of catalysts.

In accordance with the invention, the process comprises a step in which the $H_2S$ is at least partially eliminated from the effluent obtained at the end of the first hydrodesulphurization step. This step may be carried out using any of the techniques known to the skilled person. It may be carried out directly under the same conditions as the effluent is under at the end of this step or after the conditions have been changed in order to facilitate elimination of at least a portion of the $H_2S$. An example of a technique which may be envisaged which may be cited is a gas/liquid separation (where the gas becomes concentrated in $H_2S$ and the liquid is depleted in $H_2S$), a step for stripping the effluent, a step for amine washing, a step for capturing $H_2S$ by an adsorbent mass operating on the gaseous or liquid effluent, or a separation of $H_2S$ from the gaseous or liquid effluent by means of a membrane. A combination of one or more of the possibilities presented above is also possible such as, for example, a gas/liquid separation following which the liquid effluent is sent to a stripping column while the gaseous effluent is sent to an amine washing step.

Referring to FIG. 1, the effluent obtained from the reactor for the first hydrodesulphurization step is sent via the line 5 to a stripping column 6 which can separate a gaseous stream 7 containing hydrogen overhead and $H_2S$ and an effluent containing a mixture of partially desulphurized hydrocarbons 8 which is free of $H_2S$ from the bottom.

Surprisingly, the inventors have found that the presence of a distillate cut mixed with a gasoline cut has a positive effect on the reduction of the formation of recombination mercaptans in the partially desulphurized effluent.

Generally, at the end of the $H_2S$ separation step, a mixture of hydrocarbons is obtained with a total sulphur content in the range 100 to 1000 ppm by weight, preferably in the range 200 to 500 ppm by weight.

Referring now to FIG. 1, the effluent comprising the mixture of partially desulphurized hydrocarbons is treated in a supplemental hydrodesulphurization step (HDS) aimed at improving the final degree of desulphurization. This second step is intended to transform the refractory sulphur-containing compounds present in the mixture and which are essentially supplied by the second cut employed in the process of the invention. To this end, the effluent is sent to a hydrodesulphurization reactor 9 via the line 8 and is brought into contact with a hydrodesulphurization catalyst in the presence of hydrogen supplied via the line 10.

The operating conditions for the second hydrodesulphurization step are as follows:

- a temperature in the range 205° C. to 500° C., preferably in the range 250° C. to 320° C.;
- a pressure in the range 1 to 3 MPa, preferably in the range 1.5 to 2.5 MPa;
- a liquid hourly space velocity generally in the range 1 to 10 $h^{-1}$, preferably in the range 2 to 5 $h^{-1}$;
- a $H_2$/HC ratio in the range 50 Nliters/liter (L/L) to 500 Nliters/liter, preferably in the range 100 Nliters/liter to 450 Nliters/liter, and more preferably in the range 150 Nliters/liter to 400 Nliters/liter. The $H_2$/HC ratio is the ratio between the hydrogen flow rate at 1 atmosphere and at 0° C. and the flow rate of hydrocarbons.

In accordance with the invention, the temperature of the second HDS step is higher than that of the first HDS step, preferably at least 5° C. higher and still more preferably at least 10° C. higher. Advantageously, the second hydrodesulphurization step uses a catalyst with a hydrodesulphurization selectivity with respect to hydrogenation of olefins which is higher than the catalyst for the first hydrodesulphurization step.

The catalyst which is suitable for this hydrodesulphurization step comprises at least one metal from group VIII (groups 8, 9 and 10 of the new notation for the periodic classification of the elements: Handbook of Chemistry and Physics, 76$^{th}$ edition, 1995-1996) and at least one metal from group VIB (group 6 of the new notation for the periodic classification of the elements: Handbook of Chemistry and Physics, 76$^{th}$ edition, 1995-1996) on a suitable support.

The quantity of metal from group VIII, expressed as the oxide, is generally in the range 0.5% to 15% by weight, preferably in the range 1% to 10% by weight with respect to the total catalyst weight.

The quantity of metal from group VIB is generally in the range 1.5% to 60% by weight, preferably in the range 3% to 50% by weight with respect to the total catalyst weight.

The metal from group VIII is preferably cobalt and the metal from group VIB is generally molybdenum or tungsten.

Preferably, the catalyst for the second hydrodesulphurization step further comprises phosphorus. The quantity of phosphorus in said catalyst is preferably in the range 0.1% to 20% by weight of $P_2O_5$, more preferably in the range 0.2% to 15% by weight of $P_2O_5$, highly preferably in the range 0.3% to 10% by weight of $P_2O_5$ with respect to the total catalyst weight.

Preferably, the catalyst further comprises one or more organic compounds.

The catalyst support is usually a porous solid such as, for example, an alumina, a silica-alumina or other porous solids such as, for example magnesia, silica or titanium oxide, used alone or as a mixture with the alumina or the silica-alumina.

In order to minimize hydrogenation of the olefins present in the heavy gasoline, it is advantageous to use a preferred catalyst in which the density of molybdenum, expressed as the % by weight of $MoO_3$ per unit surface area of catalyst, is more than 0.07 and preferably more than 0.10. The catalyst of the invention preferably has a specific surface area of less than 200 $m^2/g$, more preferably less than 180 $m^2/g$, and highly preferably less than 150 $m^2/g$.

In a preferred embodiment, the selective catalyst for the second hydrodesulphurization step comprises cobalt, molybdenum and optionally phosphorus deposited on an alumina support in the following amounts:

- CoO in the range 1% to 6% by weight with respect to the total catalyst weight;
- $MoO_3$ in the range 3% to 15% by weight with respect to the total catalyst weight;
- $P_2O_5$ in the range 0 to 3% by weight with respect to the total catalyst weight;
- a specific surface area of catalyst of less than 150 $m^2/g$, preferably in the range 50 to 150 $m^2/g$.

The catalyst for the second hydrodesulphurization step is preferably used at least in part in its sulphurized form. Sulphurization consists of passing the feed containing at least one sulphur-containing compound which, once decomposed, fixes sulphur on the catalyst. This feed may be gaseous or liquid, for example hydrogen containing $H_2S$, or a liquid containing at least one sulphur-containing compound. The sulphurization step may be carried out in situ, i.e. within the process of the invention, or ex situ, i.e. in a unit dedicated to sulphurization of catalysts.

After the second hydrodesulphurization step, the desulphurized effluent has a total sulphur content which is generally less than 50 ppm by weight, preferably less than 30 ppm by weight, and has a mercaptans content which is generally less than 10 ppm by weight.

In accordance with the invention, and as shown in FIG. 1, the effluent which is withdrawn from the second hydrodesulphurization reactor 9 is sent to a separation unit 12 via the line 11. Preferably, before being separated, the effluent from the reactor is initially sent to a gas/liquid separating drum in order to separate a $H_2S$-rich gas from the liquid effluent. This liquid effluent is then sent to a stabilization column in order to eliminate the last traces of dissolved $H_2S$ and to produce a stabilized column bottom product, i.e. with a vapour pressure which has been corrected by eliminating the lightest hydrocarbon compounds. The gas/liquid separation and stabilization steps are steps which are familiar to the skilled person and are not represented in FIG. 1.

The step for separation or distillation consists of separating the stabilized effluent containing the mixture of hydrocarbons into at least two hydrocarbon cuts, namely a light hydrocarbon cut and a heavy hydrocarbon cut, both desulphurized. Preferably, the cut point is generally in the range 160° C. to 220° C., limits included. Referring to FIG. 1, the separation unit employed is a distillation column configured to separate a light desulphurized cut 13 overhead, equivalent to a gasoline cut and a heavy desulphurized cut 14 from the bottom, equivalent to a distillate cut. The gasoline cut is sent to the gasoline pool and the desulphurized distillate cut is sent to the diesel, kerosene or fuel oil pool.

Preferably, the sulphur content of the desulphurized light cut (or gasoline cut) is less than 50 ppm by weight, preferably less than 30 ppm by weight and more preferably less than 10 ppm by weight. Preferably, the sulphur content in the desulphurized heavy cut (or distillate cut) is less than 50 ppm by weight, optionally less than 30 ppm by weight or even less than 10 ppm by weight.

It is also possible to carry out the stabilization and distillation in a concomitant manner in a sidestream column with total external reflux. The distillate cut is recovered from the bottom, the gasoline cut is withdrawn as a side stream several plates below the head plate, while the lightest compounds are eliminated from the head of the column in the gaseous effluent.

Alternatively, the effluent obtained from the stabilization column containing the desulphurized mixture of hydrocarbons is separated into three cuts. In this case, the two cut points will generally be at approximately 160° C. and at approximately 220° C. The three hydrocarbon cuts have a total sulphur content of less than 50 ppm by weight, preferably less than 30 ppm by weight and still more preferably less than 10 ppm by weight.

Surprisingly, the inventors have found that employing two successive hydrodesulphurization steps with an intermediate step for elimination of $H_2S$ over a mixture of a gasoline cut and a middle or heavy distillate can in the end result in a desulphurized gasoline with a low mercaptans content and without any substantial loss of octane number, without the need for particularly severe hydrodesulphurization conditions which are generally accompanied by non-negligible hydrogenation of mono-olefinic hydrocarbons. In fact, it is known that the octane number loss linked to hydrogenation of mono-olefins during the hydrodesulphurization steps is greater when the intended sulphur content is lower, i.e. when intense elimination of the sulphur-containing compounds present in the feed is sought.

In accordance with an alternative embodiment of the process of the invention, also shown in FIG. 1, a first gasoline type hydrocarbon cut is sent to a pre-treatment reactor 15 before being mixed with a second hydrocarbon cut. As indicated above, the hydrocarbon feed is preferably a catalytically cracked gasoline cut which generally contains diolefins in a quantity in the range 0.1% to 3% by weight. The pre-treatment consists of a step for selective hydrogenation of diolefins to the corresponding mono-olefins, which is carried out in the presence of a catalyst and hydrogen. The catalyst for selective hydrogenation of the diolefins which is suitable for the pre-treatment comprises at least one metal from group VIB and at least one metal from group VIII deposited on a porous support as described in the Applicant's patent applications FR 2 988 732 and EP 2 161 076. The selective catalytic hydrogenation reaction is generally carried out in the presence of hydrogen, at a temperature in the range 80° C. to 220° C., preferably in the range 90° C. to 200° C., with a liquid hourly space velocity (LHSV) in the range 1 to 10 $h^{-1}$, the unit for the liquid hourly space velocity being a liter of feed per liter of catalyst per hour (L/L·h). The operating pressure is in the range 0.5 MPa to 5 MPa, preferably in the range 1 to 4 MPa.

In general, the gasoline produced contains less than 0.5% by weight of diolefins, preferably less than 0.25% by weight of diolefins.

Advantageously and as indicated in FIG. 1, the first pre-treated hydrocarbon cut is directed via the line 16 to a separation column 17 (splitter) which is designed to fractionate said pre-treated feed respectively into a light C5– fraction and a heavy C6+ fraction. The light fraction is advantageously sent to the gasoline pool via the line 18, while the heavy C6+ fraction entering line 1 is hydrodesulphurized using the process described above, i.e. as a mixture with a middle or heavy distillate cut with a low olefins content.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 13/62.892, filed Dec. 18, 2013 are incorporated by reference herein.

EXAMPLES

Example 1 (Comparative)

A hydrodesulphurization catalyst α was obtained by impregnation "without excess solution" of a transition alumina in the form of beads with a specific surface area of 130 $m^2/g$ and a pore volume of 0.9 mL/g, using an aqueous solution containing molybdenum and cobalt in the form of ammonium heptamolybdate nitrate. The catalyst was then dried and calcined in air at 500° C. The cobalt and molybdenum contents of the catalyst α were 3% by weight of CoO and 10% by weight of $MoO_3$.

50 mL of catalyst α was placed in a fixed bed tubular hydrodesulphurization reactor. Firstly, the catalyst was sulphurized by treatment for 4 hours at a pressure of 3.4 MPa at 350° C. in contact with a feed constituted by 2% by weight of sulphur in the form of dimethyldisulphide in n-heptane.

The treated feed C was a catalytically cracked gasoline with an initial boiling temperature of 61° C. and an end point of 162° C. Its sulphur content was 765 ppm by weight and its bromine index (IBr) was 75.9 g/100 g, which approximately corresponded to 42% by weight of olefins.

This feed C was treated with the catalyst α at a pressure of 2 MPa, a volumetric ratio of hydrogen to the feed to be treated ($H_2$/HC) of 300 NL/L and a HSV of 4 $h^{-1}$. After treatment, the effluent was cooled and the $H_2S$-rich hydrogen was separated from the liquid gasoline, and the gasoline underwent a stripping treatment by injecting a stream of hydrogen in order to eliminate residual traces of $H_2S$ dissolved in the desulphurized gasoline.

Table 1 shows the influence of the temperature applied on the degrees of desulphurization and RON index on the desulphurized effluents.

TABLE 1

| Analysis of desulphurized gasoline | Temperature in the hydrodesulphurization reactor, 285° C. | Temperature in the hydrodesulphurization reactor, 295° C. |
|---|---|---|
| Mercaptans, ppm by weight | 16 | 7 |
| Total sulphur, ppm by weight | 25 | 12 |
| Degree of desulphurization, % | 96.7 | 98.4 |
| RON loss | 6.9 | 8.4 |

It will be seen that when the temperature employed increases, the degree of desulphurization is improved, but at the price of an increase in the degree of hydrogenation of the olefins.

Example 2 (Comparative)

50 mL of a hydrodesulphurization catalyst β in the form of extrudates with a specific surface area of 180 $m^2/g$ with a quantity (by weight of oxide(s) with respect to the total catalyst weight) of cobalt, molybdenum and phosphorus of 4.4% by weight of CoO and 21.3% by weight of $MoO_3$ and 6.0% by weight of $P_2O_5$ respectively was placed in a fixed bed tubular hydrodesulphurization reactor. Firstly, the catalyst was sulphurized by treatment for 4 hours at a pressure of 2 MPa at 350° C. in contact with a feed constituted by 2% by weight of sulphur in the form of dimethyldisulphide in n-heptane.

The treated feed D had an initial boiling temperature of 160° C. and an end point of 269° C. Its sulphur content was 5116 ppm by weight and its bromine index (IBr) was 19.5 g/100 g, which approximately corresponded to 10% by weight of olefins. The fraction of feed D with a boiling temperature in the range 220° C. to 269° C. was 26.3% by weight.

The feed D was treated with the catalyst β at a temperature of 300° C., at a pressure of 2 MPa, with a volumetric ratio of hydrogen to the feed to be treated ($H_2$/HC) of 300 Nl/L and a HSV of 4 $h^{-1}$. After treatment, the effluent was cooled and the $H_2S$-rich hydrogen was separated from the liquid effluent and the effluent underwent a stripping treatment by injecting a stream of hydrogen in order to eliminate residual traces of dissolved $H_2S$ before being analysed.

Table 2 indicates the degree of desulphurization and the sulphur and mercaptans content of the desulphurized effluent.

TABLE 2

| Analysis | |
|---|---|
| Mercaptans, ppm by weight | 12 |
| Total sulphur, ppm by weight | 34 |
| Degree of desulphurization, % | 99.3 |

Example 3 (Comparative)

A feed E tested in Example 3 was a mixture containing 50% by weight of feed C and 50% by weight of feed D. The initial boiling temperature of the mixture was 61° C. and the end point was 269° C. Its sulphur content was 2512 ppm by weight and its bromine index (IBr) was 53.4 g/100 g, which approximately corresponded to 29.2% by weight of olefins.

This feed E was firstly treated over the catalyst α at a temperature of 330° C., at a pressure of 2 MPa, with a volumetric ratio of hydrogen to the feed to be treated ($H_2$/HC) of 300 Nl/L and a HSV of 4 $h^{-1}$. After treatment, the effluent was cooled and the $H_2S$-rich hydrogen was separated from the liquid effluent and the effluent underwent a stripping treatment by injecting a stream of hydrogen in order to eliminate residual traces of dissolved $H_2S$.

The effluent was then separated into two cuts: a first cut (gasoline cut) with a final boiling temperature of 160° C. and a second cut with an initial point of 160° C.

TABLE 3

| Analysis | 1st cut 61° C.-160° C. | 2nd cut 160° C.-269° C. |
|---|---|---|
| Mercaptans, ppm by weight | 6 | 8 |
| Total sulphur, ppm by weight | 6 | 49 |
| Degree of desulphurization, % | 99.2 | 99 |
| RON loss | 9.8 | Not applicable |

Example 4 (in Accordance with the Invention)

The feed E used in Example 3 was treated in a first hydrodesulphurization step over the catalyst β at a temperature of 260° C., at a pressure of 2 MPa, with a volumetric ratio of hydrogen to the feed to be treated ($H_2$/HC) of 300 Nl/L and a HSV of 4 $h^{-1}$. After treatment, the effluent obtained from the first hydrodesulphurization step was cooled, the $H_2S$-rich hydrogen was separated from the liquid effluent and the effluent underwent a stripping treatment by injecting a stream of hydrogen in order to eliminate residual traces of dissolved $H_2S$. The stripped effluent constituted the feed F treated in the second hydrodesulphurization step.

The feed F was then treated in a second hydrodesulphurization step over the catalyst α, at a temperature of 280° C., at a pressure of 2 MPa, with a volumetric ratio of hydrogen to the feed to be treated ($H_2$/HC) of 300 Nl/L and a HSV of 4 $h^{-1}$. After treatment, the effluent obtained from the second hydrodesulphurization step was cooled, the $H_2S$-rich hydrogen was separated from the liquid effluent and the effluent underwent a stripping treatment by injecting a stream of hydrogen in order to eliminate residual traces of dissolved $H_2S$.

The effluent from the second hydrodesulphurization step was then separated into two cuts: a first cut (gasoline cut) with a final boiling temperature of 160° C. and a second cut with an initial point of 160° C.

TABLE 4

| References | 1st cut 61° C.-160° C. | 2nd cut 160° C.-269° C. |
|---|---|---|
| Mercaptans, ppm by weight | 7 | 11 |
| Total sulphur, ppm by weight | 9 | 42 |
| Degree of desulphurization, % | 98.8 | 99.2 |
| RON loss | 5.9 | Not applicable |

Example 3 shows that it is possible, starting from a mixture of hydrocarbons comprising at least one first hydrocarbon cut with a boiling temperature in the range 61° C. to 160° C. and with an olefins content of 42% by weight and a second hydrocarbon cut with a boiling temperature in the range 160° C. to 269° C. wherein the fraction with a boiling temperature of more than 220° C. is 26.3%, to obtain two desulphurized cuts with a sulphur content of less than 10 ppm by weight of sulphur for the desulphurized cut with a boiling temperature in the range 61° C. to 160° C. and less than 50 ppm by weight of sulphur for the desulphurized cut with a boiling temperature in the range 160° C. to 269° C. respectively, while limiting the loss of RON index linked in particular to hydrogenation of a portion of the olefins present in the mixture.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the concomitant production of at least two hydrocarbon cuts with low sulphur contents from a mixture of hydrocarbons having an initial boiling temperature in the range 35° C. to 100° C. and a final boiling temperature in the range 260° C. to 340° C. and having a total sulphur content in the range 30 to 10000 ppm by weight, said hydrocarbon mixture comprising:

at least one first fraction comprising hydrocarbons having a boiling temperature range in the range from the initial boiling temperature of the mixture to 160° C. and with an olefins content in the range 20% to 80% by weight of said first fraction; and at least one second fraction comprising hydrocarbons having a boiling temperature range in the range 160° C. to the final boiling temperature of the mixture, said second fraction comprising at least 10% by weight of hydrocarbons with a boiling temperature range in the range 220° C. to the final boiling temperature of the mixture;

the process comprising the following steps:

a) in a first reactor, treating the mixture in a first hydrodesulphurization step in the presence of hydrogen and a catalyst comprising at least one metal from group VIII, at least one metal from group VIB and a support, the first hydrodesulphurization step being carried out at a temperature in the range 200° C. to 400° C., at a pressure in the range 1 to 10 MPa, with a liquid hourly space velocity in the range 0.1 to 10 $h^{-1}$ and with a (volume of hydrogen/volume of hydrocarbon mixture) ratio in the range 50 to 500 Nliter/liter;

b) separating at least a portion of the hydrogen sulphide from the partially desulphurized effluent obtained from step a);

c) in a second reactor, treating the partially desulphurized mixture obtained from step b) in a second hydrodesulphurization step in the presence of hydrogen and a catalyst comprising at least one element from group VIII, at least one element from group VIB and a support, the second hydrodesulphurization step being carried out at a temperature in the range 205° C. to 500° C., at a pressure in the range 1 to 3 MPa, with a liquid hourly space velocity in the range 1 to 10 $h^{-1}$ and with a (volume of hydrogen/volume of mixture) ratio in the range 50 to 500 Nliter/liter, the temperature of the second hydrodesulphurization step c) being higher than that of the first hydrodesulphurization step a); and d) fractionating the desulphurized mixture obtained from step c) into at least two desulphurized hydrocarbon cuts, light and heavy, the light hydrocarbon cut having an initial boiling temperature in the range 35° C. to 100° C. and a final boiling temperature in the range 160° C. to 220° C. and wherein the total sulphur content is less than 50 ppm by weight and the heavy hydrocarbon cut has an initial boiling temperature in the range 160° C. to 220° C. and a final boiling temperature in the range 260° C. to 340° C.

2. The process according to claim 1, in which the catalyst for step a) comprises a metal from group VIII selected from nickel and cobalt and a metal from group VI selected from molybdenum and tungsten.

3. The process according to claim 1, in which the catalyst for step a) comprises phosphorus.

4. The process according to claim 1, in which the catalyst for step c) comprises a metal from group VIII selected from nickel and cobalt and a metal from group VI selected from molybdenum and tungsten.

5. The process according to claim 4, in which the catalyst for step c) further comprises phosphorus.

6. The process according to claim 1, in which the first hydrocarbon fraction is a gasoline cut obtained from a catalytic cracking unit.

7. The process according to claim 6, in which the first hydrocarbon fraction is a $C6^+$ hydrocarbon cut obtained by distillation of a gasoline cut obtained from a catalytic cracking unit.

8. The process according to claim 7 in which, before the distillation step, the gasoline cut has undergone a step for selective hydrogenation of the diolefins present in said gasoline cut.

9. The process according to claim 6 in which, before step a), a step is carried out for mixing the first and second hydrocarbon cuts upstream of the reactor for the first hydrodesulphurization step.

10. The process according to claim 6, in which the first and second hydrocarbon cuts are mixed in the reactor for the first hydrodesulphurization step.

11. The process according to claim 1, in which the second hydrocarbon fraction is selected from a light cycle oil, a heavy diesel cut, a vacuum distillate cut, a hydrocarbon cut obtained from a visbreaking unit and a hydrocarbon cut obtained from a coking unit.

12. The process according to claim 1, in which the mixture contains a gasoline cut and a light cycle oil.

13. The process according to claim 12, in which said mixture is the product of a distillation of an effluent obtained from a catalytic cracking unit.

14. The process according to claim 1, in which the temperature of step c) is higher than the temperature of step a) by at least 5° C.

15. The process according to claim 1, in which the temperature of step c) is higher than the temperature of step a) by at least 10° C.

* * * * *